United States Patent [19]

Weichman

[11] 4,234,230

[45] Nov. 18, 1980

[54] IN SITU PROCESSING OF MINED OIL SHALE

[75] Inventor: Bernard E. Weichman, Houston, Tex.

[73] Assignee: The Superior Oil Company, Houston, Tex.

[21] Appl. No.: 56,595

[22] Filed: Jul. 11, 1979

[51] Int. Cl.[3] ..... E21C 41/10

[52] U.S. Cl. ..... 299/2; 299/5

[58] Field of Search ..... 299/2, 4, 5; 175/53; 208/11 R; 423/119

[56] References Cited

U.S. PATENT DOCUMENTS

| | | | |
|---|---|---|---|
| 2,481,051 | 12/1945 | Uren | 299/2 |
| 3,001,776 | 9/1961 | Van Poollen | 299/2 X |
| 3,460,867 | 8/1969 | Cameron et al. | 299/2 |
| 3,661,423 | 5/1972 | Garret | 299/2 |
| 3,739,851 | 6/1973 | Beard | 299/4 X |
| 3,759,574 | 9/1973 | Beard | 299/4 |
| 3,779,601 | 12/1973 | Beard | 299/4 |
| 3,821,353 | 6/1974 | Weichman | 423/119 |
| 3,950,029 | 4/1976 | Timmins | 299/2 |
| 3,957,305 | 5/1976 | Peterson | 299/2 |
| 4,131,416 | 12/1978 | Watson et al. | 299/2 |

*Primary Examiner*—Ernest R. Purser

*Attorney, Agent, or Firm*—Arnold, White & Durkee

[57] ABSTRACT

A method for the recovery of products from nahcolite-bearing oil shale ore deposits which comprises, in pertinent part, in situ retorting of oil shale ore from which a major portion of the nahcolite has been separated.

11 Claims, 1 Drawing Figure

IN SITU PROCESSING OF MINED OIL SHALE

BACKGROUND OF THE INVENTION

1. Field of the Invention

This invention relates to the production of minerals from oil shale deposits, and, more particularly, to recovery of nahcolite and hydrocarbon products by in situ retorting of mined, nahcolite-bearing oil shale ore from which a major portion of the nahcolite has been separated.

2. Background of the Invention

Nahcolite is a naturally occurring sodium bicarbonate which is sometimes found in substantial quantities in oil shale deposits. As used herein, the terms "ore" and "oil shale ore" refer to such nahcolite-bearing oil shale, and "oil shale" refers to the fraction that remains after a major portion of the nahcolite has been removed from the ore.

Deposits of oil shale ore have not been utilized to a significant extent as an oil source due to the relatively high cost of mining and recovering the oil, and the environmental considerations involved in such an operation. Oil shale ore formations contain hydrocarbons which exist in the form of kerogen. For all practical purposes, kerogen is immobile within the shale. However, it is well-known in the art that hydrocarbons can be recovered by heating the oil shale in a process called retorting. Two basic techniques have been utilized for this purpose: surface retorting and in situ retorting.

In U.S. Pat. No. 3,821,353 to Weichman, there is disclosed a process for recovering hydrocarbons, aluminum, sodium carbonate and/or nahcolite from oil shale ore. Further, mechanical separation of nahcolite from oil shale, leaching of nahcolite from oil shale, and recovery of alumina and aluminum hydroxide from retorted oil shale are disclosed. In particular, Weichman discloses two methods of retorting, neither of which involves in situ retorting.

Methods of in situ retorting are well-known in the art. As the name suggests, the retort chamber is formed in the oil shale deposit. According to well-known procedures, the retort chamber may comprise one or a plurality of rooms within a gallery. Rooms are formed by removing a portion of the shale from the ore deposit by conventional mining techniques such as room and pillar mining. The surrounding shale is then rubblized by use of explosives, and the rubblized shale is then retorted by in situ combustion or by heating gases externally and passing them through the rubblized bed. With either technique, the hydrocarbons produced are recovered at the lower end of the retort.

In particular, U.S. Pat. No. 3,950,029 to Timmins and 3,957,305 to Peterson describe in situ retorting of oil shale. In the '029 patent, a method of in situ retorting is described wherein a retorting zone is formed in the deposit and the zone comprises at least two galleries separated by a barrier wall which is sufficiently thick to prevent leakage of gas between galleries. Each gallery comprises a plurality of rooms having walls substantially thinner than the barrier wall between galleries. The rooms are constructed by conventional mining techniques of removing a portion of the shale within the defined room and rubblizing the surrounding shale by use of explosives or other suitable techniques. Timmins suggests that one gallery can then be retorted while work continues in an adjoining gallery.

The '305 patent discloses formation of the in situ retort chambers by means of a side excavating machine. A major portion of the excavated shale is deposited in the chambers. Once excavation is completed and the retort chambers are suitably sealed, the chambers formed according to the above description are then retorted.

In situ retorting reduces the problems of cooling and disposing of the spent shale inherent in surface retorting; however, the known and above-described in situ methods likewise have inherent problems which must be considered in making an in situ operation commercially feasible.

Present methods of in situ retorting do not provide for recovery of minerals other than hydrocarbons and, in the instance of hydrocarbon recovery, provisions could be made for more economical, efficient recovery.

In particular, the present methods of retorting which utilize explosives to rubblize the shale have many problems. With blasting it is difficult to control the size distribution of the oil shale ore particles in the retort volume. Many large boulders that result from the blast do not fully retort. Also, the smaller particules, i.e., the "fines," produced by the blast tend to produce areas of low permeability in the retort. Since the burning front in the retorting zone advances more rapidly in the more permeable zones, "channelling" of flow can result during the retorting operation, which can result in substantial quantities of oil shale ore not being fully retorted. Inefficiency and environmental damage also may result from those processes where the in situ retort is not fully sealed. For example, water can leak into the retort during burning, causing great heat loss, and ground water can be contaminated. Finally, methods currently employed for separating nahcolite from oil shale ore can create nahcolite particles which can be carried away by winds resulting in environmentally undesirable dust.

SUMMARY OF THE INVENTION

A significant feature of the method of the present invention comprises the in situ retorting of nahcolite-bearing oil shale ore from which a major portion of the nahcolite has been separated. Yet another significant feature of the present invention comprises the prevention of channeling during retorting by removal of relatively small particles, i.e. the "fines," from the oil shale which is retorted. These features permit the economic, efficient, and environmentally sound recovery of nahcolite and shale oil from nahcolite-bearing oil shale ore deposits.

In accordance with one embodiment of the method of this invention, oil shale ore is extracted from a retort zone and subjected to underground impact crushing. This step produces relatively "coarse" particles and relatively "fine" particles. Since nahcolite is more brittle than oil shale, a majority of the relatively "fine" particles are nahcolite, while a majority of the relatively "coarse" particles are oil shale. The finer particles are separated by size from the coarser oil shale particles, such as by screening, and the coarser particles are then returned to the original mined out chamber which forms the in situ retort, from which hydrocarbons are recovered. The finer particles, comprising substantially nahcolite, are then brought to the surface as product.

In accordance with another feature of this invention, the oil shale particles are grouped by size and the smallest oil shale particles are placed on the floor of the in situ retort and progressively larger oil shale particles are stacked on top. Before retorting, the retort may be sealed and, thereafter, hydrocarbons can be recovered during retorting of the shale.

Another feature of the invention includes the further separation of nahcolite from the oil shale to be retorted by leaching the nahcolite from the coarse oil shale particles and recovering sodium carbonate by evaporating the aqueous leach liquor. The oil shale ore subjected to this leaching step can then be efficiently retorted to recover hydrocarbon products.

The in situ recovery of products is environmentally advantageous for many reasons. In particular, the nahcolite recovered in situ may be used for air pollution control and its recovery in situ reduces generation of dust particles which damage the environment. Further, in situ retorting obviates spent shale disposal problems. Still further, efficient in situ retorting results in conservation of fuel. Other environmental advantages will become apparent to those skilled in this art from a reading of the complete specification.

DESCRIPTION OF SPECIFIC EMBODIMENT

Figure 1:
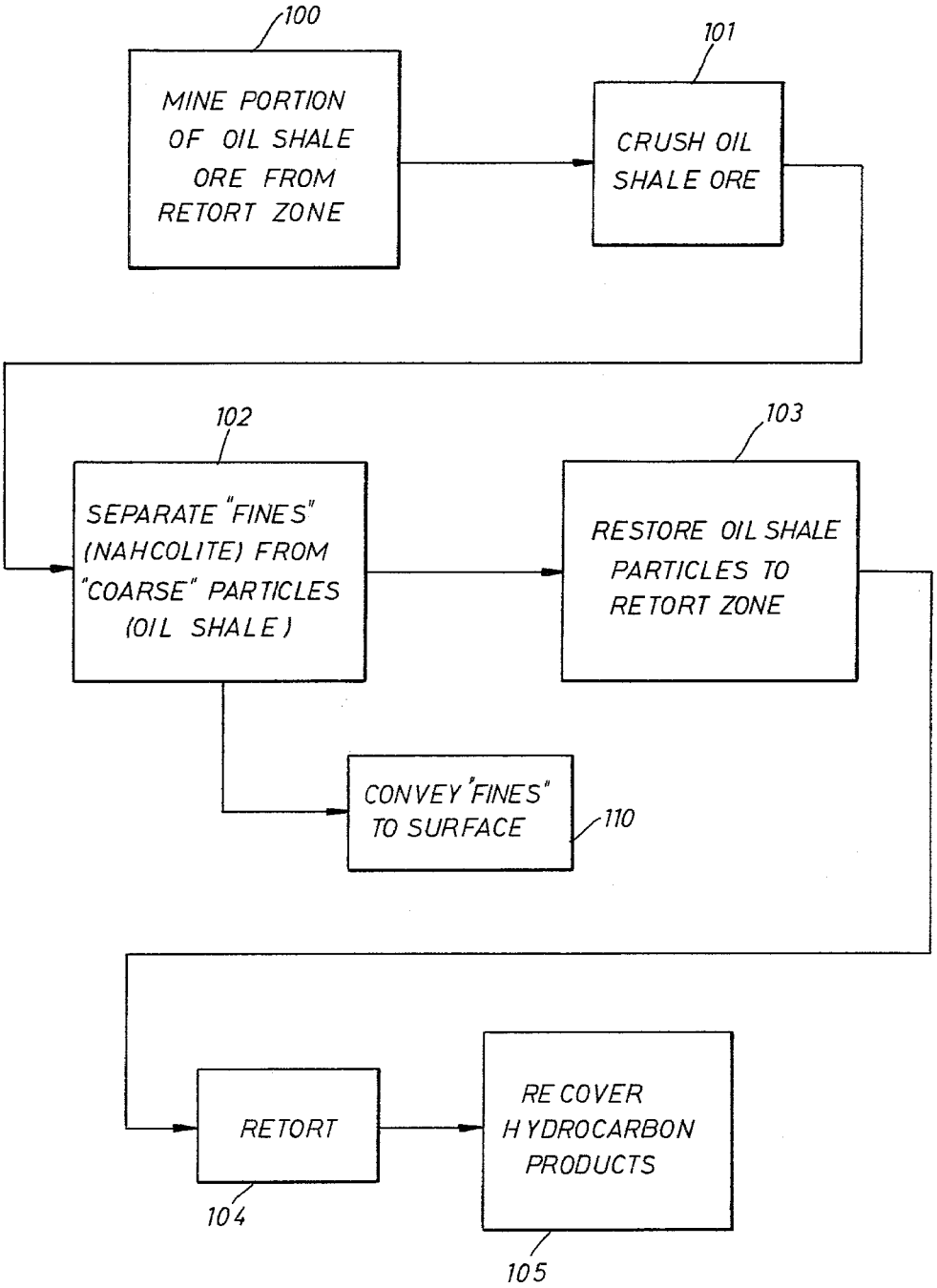
FIG. 1 is a block flow diagram which shows the sequence of steps according to one embodiment of the method of the present invention.

It will be appreciated that the method of the present invention may have many embodiments. One embodiment of the method is described to give an understanding of the invention. It is not intended that the description herein should limit the true scope and spirit of the invention.

Referring to FIG. 1, the method of the present invention first comprises the step 100 of mining a portion of the oil shale ore from the retort zone. Step 100 may be accomplished with conventional techniques, e.g., the room and pillar method.

The next step in accordance with the present invention is to subject the mined oil shale ore to impact crushing (step 101), which produces particles of various sizes. Since the nahcolite is more brittle than the oil shale, the smaller, i.e., "finer" particles comprise substantially nacholite, while the larger, i.e. "coarser," particles comprise substantially oil shale.

The next step 102 of the method according to the present invention is to separate the crushed particles by size to remove the smaller nahcolite particles from the coarser oil shale particles. This step results in the separation of a substantial portion of the nahcolite from the oil shale. In situ separation of nahcolite eliminates dust hazards which may be created when this operation is conducted on the surface. This separation step may be carried out by one or more sequential impact crushing steps followed by screening, or by a series of impact crushing and screening steps. In either event, during screening, particles of a size less than about 35 mesh are separated from the large particles. In one embodiment, the smaller particles are then conveyed to the surface, as shown diagrammatically by step 110. Although the smaller particles screened out are substantially nahcolite, they may contain as much as about 20–30 percent oil shale. This material may be sold "as is" for air pollution control, e.g., cleaning flue gases and the like. In particular, this material may be used as a scrubbing agent for the removal of oxides of sulfur, nitrogen, and other elements from flue gas. Alternatively, the fines may be subjected to a water leach, filtration, and calcining of the filtered leach liquor to recover pure sodium carbonate.

The next step 103 of the present method is to restore the remaining coarser oil shale particles, from which about 60 to about 80 percent of the nahcolite has been removed, to the retort zone. In a preferred embodiment, step 103 comprises selectively grouping the oil shale particles according to size. This grouping may be accomplished by sequential screening of the particles through screens of different mesh sizes, or by any other appropriate method of separation, such as optical sorting. The smallest particles are placed on the floor of the retort zone, with progressively larger particles being placed on top.

The purpose of this particular stacking arrangement is two-fold; it allows for good distribution of flow with a minimum of channelling, and it allows for retorting to terminate after the larger particles are completely retorted. This latter phenomenon occurs because the smaller particles on the bottom (gas-exit side of the retort) require less heat to completely retort, and, accordingly, the retorting operation is terminated when the larger particles at the top are completely retorted. Appropriate piping may be laid or installed across the top or above the bed of oil shale to be retorted, to insure good flow distribution of hot gas or of natural gas and air for combustion retorting, through the retort zone. Before retorting, all entrances into the retort zone should be sealed. The seals can be formed by pouring grout, for example concrete, into a suitable form.

Hydrocarbons may be recovered from the oil shale by subjecting it to heat, i.e. retorting it, as shown in step 104. Although other products may be recovered from the oil shale if heat is applied in a controlled manner and the temperature does not exceed a certain maximum, as set forth in U.S. Pat. No. 3,821,353, combustion retorting is the preferred method for underground or in situ retorting in the absence of a substantial aluminum content in the ore. This is accomplished by initially supplying natural gas or the like to the top of the retort bed, igniting it, and maintaining combustion in the bed in a downwardly-moving combustion front through the retort. It should be understood that the particular arrangement of the oil shale particles comprising the retort bed and the use of distribution pipes where appropriate will allow for the even distribution of gas flow through the retorted bed.

As the heat front generated by the combustion passes through the retort bed, pyrolysis occurs and hydrocarbons are driven from the shale. These hydrocarbons may condense on the relatively cooler shale particles below, and eventually are recovered at the bottom of the retort, as indicated in step 105. Preferably, this collection is made in a sump which has been formed at or near the bottom of the retort. The collected hydrocarbons may then be pumped to the surface and further processed or treated as described in U.S. Pat. No. 3,821,353. It should be understood that a portion of the hydrocarbons also may be recovered from the oil shale ore which forms the support pillars and the barriers, and from other surrounding oil shale ore exposed to the heat.

It will be appreciated that when hot gas retorting is used, the temperature at which the retorting operation is carried out may be controlled with greater precision than when combustion retorting is used. For reasons set forth more specifically in U.S. Pat. No. 3,821,353, the optimum retort temperature may be as high as 550° C. to 600° C., but preferably is controlled at about 475° C. if it is desired to maximize recovery of aluminum values from the retorted shale. This optimum temperature may vary according to the composition of the oil shale ore to be retorted, and the higher temperatures of combustion retorting can be utilized if alumina is not to be recovered.

After retorting at controlled temperature, the spent shale may be subjected to a caustic leach in order to recover aluminum hydroxide. It should be understood that the hydrocarbons and nahcolite recovered in the practice of this invention may be further processed to produce other related products. For example, the nahcolite recovered during the screening step may be subjected to a water leach, and the leach liquor filtered and then calcined to produce sodium carbonate. The sodium carbonate may be used in the make up of the caustic leach. Again, a more detailed description of these processes may be found in U.S. Pat. No. 3,821,353.

The description of the foregoing particular and preferred embodiments is not intended to limit the scope of this invention. Various modifications of the disclosed embodiments, as well as other embodiments of the invention, may be apparent to persons skilled in the art upon reference to this description. For example, the step of separating the crushed ore particles to obtain a substantially nahcolite fraction and a substntially oil shale fraction may be accomplished by optical sorting. It is therefore contemplated that the appended claims will cover any such modifications or embodiments as fall within the true scope of the invention.

What is claimed is:

1. A method of recovering products from a nahcolitebearing oil shale ore deposit comprising the steps of:

(a) defining a retort zone within the deposit;
(b) mining the nahcolite-bearing oil shale ore from the retort zone;
(c) crushing the mined oil shale ore to form particles comprising substantially nahcolite and particles comprising substantially oil shale;
(d) separating the substantially nacholite particles from the substantially oil shale particles to recover a substantially nahcolite product;
(e) restoring the oil shale particles to the retort zone; and
(f) retorting the oil shale particles to recover hydrocarbon products.

2. The method of claim 1, wherein the separating of the substantially nahcolite particles from the substantially oil shale particles comprises screening the particles to produce a larger sized fraction of substantially oil shale particles and a smaller sized fraction of substantially nahcolite particles.

3. The method of claim 2 comprising the additional steps of:

(a) installing flow distribution piping in the retort zone; and
(b) sealing the retort zone prior to retorting.

4. The method of claim 3, wherein the step of restoring the substantially oil shale particles to the retort zone comprises:

(a) segregating the oil shale particles into a plurality of size groups; and
(b) progressively restoring the oil shale particles to the retort zone according to size, the smallest size oil shale particles being restored to the retorting zone first.

5. The method of claim 4, wherein the step of retorting comprises combustion retorting.

6. The method of claim 5, wherein said combustion retorting comprises:

(a) supplying natural gas and air to the top of the retort zone;
(b) igniting said gas; and
(c) maintaining combustion in said oil shale particles in a moving combustion front through the retort zone.

7. The method of claim 1, wherein said oil shale ore includes dawsonite and said retorting comprises noncombustion heating to recover hydrocarbon products and to convert said dawsonite to a more soluble aluminum compound; and comprising the additional steps of:

(a) caustic leaching of the retorted, spent shale to dissolve the aluminum compound; and
(b) precipitating aluminum hydroxide from the caustic leach liquor.

8. The method of claim 2, wherein at least about three-fourths of the nahcolite is removed from the mined oil shale ore by screening and is recovered in the smaller sized, substantially nahcolite fraction.

9. The method of claim 1, wherein at least 60% of the nahcolite is removed from the mined oil shale ore in the separation step.

10. A method of recovering hydrocarbon products, nahcolite, and alumina from a nahcolite-bearing oil shale ore deposit which includes dawsonite, comprising the steps of:

(a) mining the oil shale ore from and constructing a retorting zone within said deposit, wherein said retorting zone comprises a room substantially enclosed by a barrier pillar, and wherein said room is supported by a plurality of pillars whose volume is approximately 25% of the volume of said retorting zone;
(b) crushing said mined oil shale ore to produce fine nahcolite particles and relatively coarser oil shale particles;
(c) screening the fine nahcolite particles from the coarser oil shale particles to recover the nahcolite;
(d) sealing the retorting zone against entry of water;
(e) returning the coarser oil shale particles to the retorting zone;
(f) retorting said oil shale in situ by heating to recover hydrocarbon products and to convert the dawsonite to a more soluble aluminum compound;
(g) leaching the spent shale with caustic to dissolve the aluminum compound;
(h) precipitating aluminum hydroxide from the caustic leach liquor; and
(i) calcining the aluminum hydroxide to recover alumina.

11. The method of claim 10 comprising the additional steps of:

(a) leaching the remaining nahcolite from said coarser oil shale particles;
(b) filtering and evaporating the aqueous leach liquor to recover sodium carbonate; and
(c) drying the oil shale particles prior to retorting.

* * * * *